US007208256B2

(12) United States Patent
Tanaka et al.

(10) Patent No.: US 7,208,256 B2
(45) Date of Patent: Apr. 24, 2007

(54) TONER FOR IMAGE FORMATION, METHOD OF PRODUCING THE TONER, TONER CONTAINER, TONER CARTRIDGE, PROCESS CARTRIDGE, AND IMAGE FORMING APPARATUS

(75) Inventors: Chiaki Tanaka, Shizuoka-ken (JP); Naohiro Watanabe, Shizuoka-ken (JP); Takeshi Takada, Numazu (JP); Ryohta Inoue, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 298 days.

(21) Appl. No.: 10/802,887

(22) Filed: Mar. 18, 2004

(65) Prior Publication Data

US 2005/0026066 A1 Feb. 3, 2005

(30) Foreign Application Priority Data

Mar. 19, 2003 (JP) ..... 2003-075498
May 6, 2003 (JP) ..... 2003-128384

(51) Int. Cl.
*G03G 9/00* (2006.01)

(52) U.S. Cl. ..... 430/109.4; 430/137.17; 430/108.3

(58) Field of Classification Search ..... 430/109.4, 430/137.17, 108.3
See application file for complete search history.

(56) References Cited

U.S. PATENT DOCUMENTS 2,297,691 A 10/1942 Carlson
2,931,899 A 4/1960 Peterson
4,518,672 A * 5/1985 Urawa et al. ..... 430/108.21
5,344,985 A 9/1994 Tanaka et al.
5,409,794 A * 4/1995 Ong ..... 430/108.3
5,420,332 A 5/1995 Shimada et al.
5,434,028 A 7/1995 Shimada et al.
5,457,232 A 10/1995 Tanaka et al.
5,459,275 A 10/1995 Tanaka et al.
5,480,753 A 1/1996 Shimada et al.
5,547,792 A 8/1996 Shimada et al.
5,576,132 A 11/1996 Tanaka et al.
5,587,516 A 12/1996 Tanaka et al.
5,599,995 A 2/1997 Tanaka et al.
5,616,805 A 4/1997 Tanaka et al.
5,641,598 A 6/1997 Tanaka et al.
5,663,407 A 9/1997 Shimada et al.
5,672,728 A 9/1997 Tanaka et al.
5,723,243 A 3/1998 Sasaki et al.
5,789,128 A 8/1998 Adachi et al.
5,808,155 A 9/1998 Shimada et al.
5,840,454 A 11/1998 Nagai et al.
5,846,680 A 12/1998 Adachi et al.
5,910,561 A 6/1999 Adachi et al.
5,942,363 A 8/1999 Tanaka et al.
5,976,746 A 11/1999 Tanaka et al.
5,981,124 A 11/1999 Shimada et al.
6,018,014 A 1/2000 Nagai et al.
6,045,959 A 4/2000 Katayama et al.
6,066,428 A 5/2000 Katayama et al.
6,066,757 A 5/2000 Tanaka et al.
6,069,224 A 5/2000 Adachi et al.
6,103,435 A 8/2000 Shimada et al.
6,172,176 B1 1/2001 Tanaka et al.
6,184,362 B1 2/2001 Shimada et al.
6,187,494 B1 2/2001 Kawamura et al.
6,191,249 B1 2/2001 Tanaka et al.
6,194,535 B1 2/2001 Katayama et al.
6,271,356 B1 8/2001 Shimada et al.
6,303,736 B1 10/2001 Kawamura et al.
6,313,288 B1 11/2001 Shimada et al.
6,465,648 B1 10/2002 Tadokoro et al.
6,492,079 B2 12/2002 Shimada et al.
6,503,676 B2 1/2003 Yamashita et al.
6,524,761 B2 2/2003 Shimada et al.
6,544,701 B2 4/2003 Tadokoro et al.
6,548,216 B2 4/2003 Kawamura et al.
6,566,026 B2 5/2003 Watanabe et al.
6,593,048 B2 7/2003 Sasaki et al.

(Continued)

FOREIGN PATENT DOCUMENTS

JP 43-24748 10/1943

(Continued)

OTHER PUBLICATIONS

U.S. Appl. No. 11/313,817, filed Dec. 22, 2005, Inoue et al.

(Continued)

*Primary Examiner*—Mark A. Chapman
(74) *Attorney, Agent, or Firm*—Oblon, Spivak, McClelland, Maier & Neustadt, P.C.

(57) ABSTRACT

A toner for image formation is provided, which is produced by dispersing in an aqueous solvent a toner composition which includes a composition thermally soluble in an organic solvent and a coloring agent, thereby forming toner particles, wherein the thermally soluble composition includes (a) a polyester having an acid value and (b) a metal alcolate and/a metal chelate compound. The toner is capable of attaining image fixing at a sufficiently low image fixing temperature and a sufficiently broad image fixing temperature range for use in practice. Furthermore, toner containers such as a toner cartridge and a process cartridge are provided, which are loaded with the toner. Such toner containers can be detachably mounted on an image forming apparatus.

20 Claims, No Drawings

U.S. PATENT DOCUMENTS

| | | | | |
|---|---|---|---|---|
| 6,596,449 | B2 | 7/2003 | Shimada et al. | |
| 6,653,037 | B2 | 11/2003 | Sawada et al. | |
| 6,660,443 | B2 | 12/2003 | Sugiyama et al. | |
| 6,667,141 | B2 | 12/2003 | Iwamoto et al. | |
| 6,699,632 | B2 | 3/2004 | Higuchi et al. | |
| 2006/0078815 | A1* | 4/2006 | Ito et al. | 430/109.4 |

FOREIGN PATENT DOCUMENTS

| | | |
|---|---|---|
| JP | 60-090344 | 5/1985 |
| JP | 62-063940 | 3/1987 |
| JP | 64-015755 | 1/1989 |
| JP | 02-082267 | 3/1990 |
| JP | 03-041470 | 2/1991 |
| JP | 03-229264 | 10/1991 |
| JP | 11-149180 | 6/1999 |
| JP | 11-305486 | 11/1999 |

OTHER PUBLICATIONS

U.S. Appl. No. 11/513,175, filed Aug. 31, 2006, Ohki et al.
U.S. Appl. No. 11/520,642, filed Sep. 14, 2006, Chiaki Tanaka et al.
U.S. Appl. No. 11/519,893, filed Sep. 13, 2006, Ryota Inoue et al.

* cited by examiner

TONER FOR IMAGE FORMATION, METHOD OF PRODUCING THE TONER, TONER CONTAINER, TONER CARTRIDGE, PROCESS CARTRIDGE, AND IMAGE FORMING APPARATUS

BACKGROUND OF THE INVENTION

1. Field of Invention

The present invention relates to a toner for image formation, a method of producing the toner, a toner container, a toner cartridge, and a process cartridge for containing the toner therein, and an image forming apparatus to which such a toner container, toner cartridge or process cartridge is detachably attached.

2. Discussion of the Background

Electrophotographic image formation can be carried out by various methods, but it is generally carried out by forming a latent electrostatic image on the surface of a photoconductor which is prepared by use of a photoconductive material, developing the latent electrostatic image to a visible toner image with a developer, and when necessary, transferring the toner image to a transfer sheet such as a sheet of paper, and fixing the transferred toner image to the transfer sheet with application of heat and/or pressure, or by the application of the vapor of a solvent thereto, as described in, for instance, U.S. Pat. No. 2,297,691, JP-B-49-23910, and JP-B-43-24748.

Methods of developing latent electrostatic images to visible toner images can be broadly divided into two groups. One is of a liquid development type, which uses a liquid developer composed of various kinds of pigments and/or dyes, which are finely divided and dispersed in an electrically insulating organic solvent, and the other is of a dry development type, which uses a dry developer (hereinafter referred to as toner) which can be prepared by dispersing a coloring agent such as carbon black in a natural or synthetic resin. In the dry type development, for instance, a cascade method and a magnetic brush method can be employed for developing latent electrostatic images formed on the photo conductor.

In recent years, the dry type development is widely used.

In the dry type development, a heat roller is generally used for fixing toner images on the transfer sheet due to the excellent heat transfer efficiency of the heat roller.

In recent years, for energy saving, there is a growing tendency to reduce the amount of energy to be applied to the toner for fixing thereof.

In 1999, a technical research project concerning copying machines for the next generation in DMS (Demand-Side Management) Program of IEA (International Energy Association) announced the specifications for copiers with a copying speed of 30 cpm or more to the effect that it is required that the waiting time for starting image fixing be within 10 seconds, and the power consumption during the waiting time be in the range of 10 to 30 watt, although the power consumption differs depending upon copying speed. The energy saving required to be achieved in the specifications is significantly greater than that achieved in the currently employed copying machines.

As a method for meeting the above requirement, there may be a method of reducing the heat capacity of an image fixing member such as an image fixing roller, thereby increasing the temperature response of the image fixing member to the toner heated. However, this method cannot sufficiently meet the requirement.

For minimizing the waiting time to meet the above requirement, the lowering of the image fixing temperature of the toner itself is considered to be technically essential.

In order to achieve the low-temperature image fixing, a polyester resin, which has excellent low-temperature image fixing performance and relatively good heat resistance and thermal preservability, has been tested instead of the styrene-acrylic resin which has conventionally used in many cases as disclosed in JP-A-60-90344, JP-A-64-15755, JP-A-2-82267, JP-A-3-229264, JPA-3-41470, and JP-A-11-305486.

Furthermore, it was tried that a particular non-olefinic crystalline polymer was added to a binder in order to improve the low-temperature image fixing performance as disclosed in JP-A-62-63940.

Furthermore, it was tried that a crystalline polyester was used as disclosed in Japanese Patent No. 2931899. However, no optimization has not yet been made with respect to the molecular structure and molecular weight thereof.

Even if the above-mentioned prior is used, it is still impossible to meet the requirements described in the specifications of DMS (Demand-Side Management) Program. In order to meet the requirements, the establishment of a further more advanced low-temperature image fixing technology than the conventional one is indispensable.

In order to attain a further lower temperature image fixing, it is necessary to control the thermal characteristics of the resin itself to be used. However, if the glass transition temperature (Tg) of the resin is excessively lowered, the heat resistance and thermal preservability of the toner are impaired. When the softening point $F_{1/2}$ of the resin is lowered by use of a resin with a smaller molecular weight, problems such as the lowering of the hot-offset occurring temperature are caused. For these reasons, the obtaining a toner having excellent low-temperature image-fixing performance and high hot-offset occurring temperature has not been obtained by controlling the thermal characteristics of the resin itself.

In order to eliminate these shortcomings, there has been proposed a technique of using a polyester resin as a binder resin and preparing toner particles in water by utilizing an isocyanate reaction as disclosed in JP-A-11-149180. However, it cannot be said that the low-temperature image fixing can be sufficiently achieved. Furthermore, it is difficult to apply this method to a negative toner, since the toner becomes positively chargeable due to the formation of a urea group by the isocyanate-amine reaction.

SUMMARY OF THE INVENTION

Accordingly, one object of the present invention is to provide a toner for developing latent electrostatic images, for instance, for use in electrophotography, electrostatic recording, and electrostatic printing, which toner has a sufficient low-temperature image fixing performance, a sufficiently broad image fixing temperature range, and excellent toner chargeability by which highly precise images can be obtained.

Another object of the present invention is to provide a container, a toner cartridge, and a process cartridge in which the toner is loaded, and an image forming apparatus in which the toner is used.

A further object of the present invention is to provide a method of producing the toner.

These and other objects of the present invention are satisfied, either individually or in combination, by the discovery of a toner for image formation, which is produced by dispersing in an aqueous solvent a toner composition which comprises (1) a composition which is thermally soluble in an organic solvent and (2) a coloring agent, thereby forming toner particles, wherein the thermally soluble composition comprises a polyester with an acid value and a metal alcolate and/a metal chelate compound, or a toner for image formation, which is produced by dispersing in an aqueous solvent a toner composition which comprises (1) a composition thermally soluble in an organic solvent and (2) a coloring agent, thereby forming toner particles, wherein when the solvent is eliminated from the toner composition, the thermally soluble composition comprises a gel structure comprising a polyester with an acid value and a metal alcolate and/a metal chelate compound.

In the above toners, it is preferable that the polyester has an acid value of 3 to 4 mg KOH/g.

Furthermore, in the above toners, it is preferable that the metal alcolate and/or metal chelate compound comprise at least one metal ion selected from the group consisting of aluminum ion, titanium ion, and zirconium ion.

According to the present invention, the above toner can be produced by dispersing in an aqueous solvent a toner composition which comprises (1) a composition thermally soluble in an organic solvent and (2) a coloring agent, thereby forming toner particles, wherein the thermally soluble composition comprises a polyester with an acid value and a metal alcolate and/a metal chelate compound.

The present invention provides a container, a toner cartridge and a process cartridge, each comprising the above toner.

Furthermore, the present invention provides an image forming apparatus in which the above toner can be used, or on which any of the toner cartridge and the process cartridge is detachably mounted.

DETAILED DESCRIPTION OF THE PREFERRED EMBODIMENTS

The inventors of the present invention have discovered that in a method of obtaining in an aqueous solvent a toner which comprises a polyester resin as a base component, when the solvent is removed from the resin which constitutes the toner, the resin comes to have a three-dimensional cross-linked structure with a metal chelate compound, which improves the low-temperature image fixing performance and prevents the occurrence of the offset of the toner even heated to high temperatures. Furthermore, in this method, a nitrogen-containing compound such as isocyanate is not contained in the toner when the cross-linked structure is obtained, so that an extremely stable negatively chargeable toner can be obtained.

The toner of the present invention comprises as constituent components a binder resin, a coloring agent, wax, and if necessary, a charge controlling agent, organic resin particles, and other additives.

There is no particular limitation to the binder resins for use in the present invention as long as the binder resins are soluble in organic solvents. In this sense, conventional polyester resin can be used.

A specific example of the binder resin is a polycondensation product of a polyol (1) and a polycarboxylic acid (2).

Examples of the polyol (1) are a diol (1-1) and a polyol (1-2) having three or more hydroxyl groups. As such a polyol, the diol (1) only or a mixture of the diol (1-1) and a small amount of the polyol (1-2) is preferable for use.

Examples of the diol (1-1) are an alkylene glycol having 2 to 18 carbon atoms such as ethylene glycol, 2.2-propylene glycol, 1,3-propylene glycol, 1,4-butanediol, neopentyl glycol, and 1,6-hexanediol; an alkylene ether glycol having 4 to 1000 carbon atoms such as diethylene glycol, triethylene glycol, dipropylene glycol, polyethylene glycol, and polytetramethylene ether glycol; alicyclic diol having 5 to 18 carbon atoms such as 1,4-cyclohexanedimethanol and hydrogenated bisphenol A; bisphenols having 12 to 23 carbon atoms such as bisphenol A, bisphenol F, and bisphenol S; alkylene oxide (having 2 to 18 carbon atoms) (such as ethylene oxide, propylene oxide, butylene oxide, and α-olefin oxide) of the above-mentioned alicyclic diol or bisphenols, with the addition mole number being 2 to 20. Of the above-mentioned compounds, preferable are the alkylene glycol having 2 to 12 carbon atoms, and the alkylene oxide (having 2 to 18 carbon atoms) addition products of bisphenols. Particularly preferable are alkylene oxide addition products of bisphenols (bisphenol A in particular) (in particular, the addition product of 2 to 3 moles of ethylene oxide or propylene oxide), and the alkylene oxide addition products of bisphenols used in combination with an alkylene glycol having 2 to 12 carbon atoms such as ethylene glycol, 1,2-propylene glycol, 1,4-butanediol and neopentyl glycol. When the alkylene oxide addition products of bisphenols and the alkylene glycol having 2 to 12 carbon atoms are used in combination, the alkylene oxide addition products of bisphenols are usually used in an amount of 30 mole % or more, preferably in an amount of 50 mole % or more, more preferably in an amount of 70 mole % or more.

Examples of the polyol (1-2) having three or more hydroxyl groups are a polyhydric aliphatic alcohol having 3 to 8 hydroxyl groups or more hydroxyl groups, such as glycerin, trimethylolethane, trimethylolpropane, pentaerythritol, and sorbitol; phenols having 3 to 8 hydroxyl groups or more hydroxyl groups such as tris-phenol PA, phenol novolak, and cresol novolak; and alkylene oxide (having 2 to 18 carbon atoms) add of the above-mentioned alicyclic diol or bisphenols, with the addition mole number being 2 to 20.

Examples of the polycarboxylic acid (2) are a dicarboxylic acid (2-1) and a polycarboxylic acid (2-2) having three or more carboxyl groups. As such a pocrboxylic acid, the dicarboxylic acid (2) only or a mixture of the dicarboxylic acid (2-1) and a small amount of the polycarboxylic acid (2-2) is preferable for use.

Examples of the dicarboxylic acid (2-1) are an alkylene dicarboxylic acid having 2 to 20 carbon atoms such as succinic acid, adipic acid, sebacic acid, dodecane dicarboxylic acid, dodecenylsuccinic acid, and dodecylsuccinic acid; and alkenylene dicarboxylic acid such as maleic acid and fumaric acid; an aromatic dicarboxylic acid such as phthalic acid, isophthalic acid, terephthalic acid, and naphthalenedicrboxylic acid. Of these compounds, preferable are an alkylene dicarboxylic acid having 4 to 20 carbon atoms, in particular, adipic acid and dodecenylsuccinic acid, and an aromatic dicarboxylic acid having 8 to 20 carbon atoms, in particular, isophthalic acid and terephthalic acid.

Examples of the polycarboxylic acid having three or more carboxylic groups (2-2) are an aromatic polycarboxylic acid having 9 to 20 carbon atoms such as trimellitic acid and pyromellitic acid.

The polycarboxylic acid (2) may also be obtained by allowing the anhydride of any of the above acids or the lower alkyl ester such as methyl ester, ethyl ester or isopropyl ester of the above acids to react with the polyol (1).

The ratio of the polyol (1) to the polycarboxylic acid (2) is usually in the range of from 2/1 to 1/2, preferably from 1.5/1 to 1/1.5, more preferably from 1.3/1 to 1/1.3, in terms of the molar ratio of hydroxyl group [OH]/carboxyl group [COOH].

As the binder resin for use in the present invention, it is preferable to use two or more of the above-mentioned resins in combination. More specifically, a polyester resin having an acid value and a polyester resin having no acid value are used in combination. The polyester resin having an acid value, in the course of the production thereof, assumes a three-dimensional cross-linked structure by reacting with a metal alcolate and/or a metal chelate compound at the elimination of the solvent, whereby the low-temperature image fixing performance and the securing of a predetermined image fixing temperature range are balanced.

The acid value of the polyester resin having an acid value is normally in the range of 3 to 50 mg KOH/g, preferably in the range of 4 to 45 mg KOH/g, more preferably 5 to 40 mg KOH/g. In the case where only a binder resin with an acid value of less than 3 mg KOH/g is used for the contraction of the toner, the reaction with the metal alcolate and/or the metal chelate compound does not proceed, so that the three-dimensional structure cannot be sufficiently formed and the predetermined image fixing range cannot be securely obtained. When the acid value exceeds 50 mg KOH/g, the cross-linked structure becomes too dense to secure the predetermined image fixing range. The mixing ratio of the resin having such an acid value to the resin having no acid value is 2/98 to 65/35, preferably 5/95 to 60/40, more preferably 10/90 to 50/50 by weight in the toner. Tg of the polyester is normally 0 to 100° C., preferably 5 to 90° C., more preferably 10 to 80° C.

The weight average molecular weight of the polyester resin is 1000 to 50000, preferably 2000 to 40000, more preferably 3000 to 30000. In the case of a resin with a weight average molecular weight of less than 1000, in particular, when used as a polyester resin with an acid value, the predetermined image fixing temperature range cannot be secured, while in the case of a resin with a weight average molecular weight of more than 500000, in particular when used as a polyester resin without acid value, the low-temperature image fixing performance is not exhibited.

The metal alcolate and/or metal chelate compound for use in the present invention is soluble in organic solvents. There is no particular limitation to the metal alcolate and/or metal chelate compound. Conventional alcolates and/or metal chelate compounds can be employed as long as a chelate cross-linking reaction takes place between the metal alcolate and/or metal chelate compound and an acid value generating portion of the resin upon the organic solvent being eliminated in the course of the preparation of the toner. Such a metal alcolate and/or metal chelate compound is preferably selected from the group of the alcolates and/or metal chelate compounds with the metal site thereof being of bivalent or more.

More specifically, as the alcolate, there can be employed aluminum trimethylate, aluminum triethylate, aluminum tri-n-propylate, aluminum isoproprolylate, mono-sec-butoxy aluminum diisopropylate, aluminum tri-sec-butylate, and aluminum t-butylate.

As the chelate compound, there can be selected from group of compounds with keto-enol type ligands being attached to partial or total sites thereof. Specifically, there can be employed ethyl acetoacetate aluminum diisopropylate, diethylacetoacetate aluminum isopropylate, aluminum trisethyl acetoacetate, alkylacetoacetate aluminum dialkylate, aluminum monoacetyl acetonate bisethylacetoacetate, and aluminum trisethyl acetoacetate alkyl. Furthermore, cyclic compounds of the above compounds can also be employed.

When the metal is zirconium, there can be employed alcolates such as zirconium trimethylate, zirconium triethylate, zirconium tri-n-propylate, zirconium isopropylate, mono-sec-butoxy zirconium diisopropylate, zirconium tri-sec-butylate, and zirconium tri-t-butylate.

As the chelate compound, there can be selected from group of compounds with keto-enol type ligands being attached to partial or total sites thereof. Specifically, there can be employed ethyl acetoacetate zirconium diisopropylate, diethylacetoacetate zirconium isopropylate, zirconium trisethyl acetoacetate, alkylacetoacetate zirconium dialkylate, zirconium monoacetyl acetonate bisethylacetoacetate, and zirconium trisethyl acetoacetate alkyl. Furthermore, cyclic compounds of the above compounds can also be employed.

When the metal is titanium, there can be employed alcolates such as titanium trimethylate, titanium triethylate, titanium tri-n-propylate, titanium isopropylate, mono-sec-butoxy titanium diisopropylate, titanium tri-sec-butylate, and titanium tri-t-butylate.

As the chelate compound, there can be selected from group of compounds with keto-enol type ligands being attached to partial or total sites thereof. Specifically, there can be employed ethyl acetoacetate titanium diisopropylate, diethylacetoacetate titanium isopropylate, titanium trisethyl acetoacetate, alkylacetoacetate titanium dialkylate, titanium monoacetyl acetonate bisethylacetoacetate, and titanium trisethyl acetoacetate alkyl. Furthermore, cyclic compounds of the above compounds can also be employed.

In order to have the toner of the present invention exhibit the low-temperature image fixing performance, excellent image fixing temperature range, and excellent negative chargeability, the metal alcolate and/or the metal chelate compound is contained in such an amount that the equivalent ratio of the acid value generating functional group of the polyester resin having an acid value to that of the metal in terms of the valence thereof is 0.3 to 2.5, preferably 0.4 to 2.4, more preferably 0.5 to 2.3. When the amount is less than 0.3 in terms of the ratio, the cross-linking reaction density is so insufficient that excellent image fixing temperature range cannot be obtained, and when the amount is more than 2.5 in terms of the ratio, the cross-linking reaction density is likewise so insufficient that the result is the same as in the case where the amount is less than 0.3 in terms of the molar ratio.

The coloring agent for use in the toner of the present invention may be an inorganic pigment, an organic pigment, an organic dye, or a combination of any of them.

Specific examples thereof are carbon black, aniline blue, Phthalocyanine Blue, Phthalocyanine Green, Hansa Yellow, Rhodamine pigment, Chrome Yellow, quinacridone, Benzidine Yellow, Rose Bengale, triarylmethane dye, monoazo dyes and pigments, disazo dyes and pigments, and condensation azo dyes and pigments. Any conventional dyes and pigments can be used alone or in combination.

In the case of a full color toner, it is preferable to use for yellow Benzidine Yellow, monoazo dyes and pigment, and condensation dyes and pigments; for magenta quinacridone, and monoazo dyes and pigments; for cyan Phthalocyanine Blue. Of these coloring agents, it is preferable to use as a cyan coloring agent Pigment Blue 15:3, as a yellow pigment Pigment Yellow 74 and Pigment Yellow 93, as a magenta coloring agent, quinacridone type compounds.

The amount of the coloring agent to be added is preferably in the range of 2 to 25 parts by weight to 100 parts by weight of the binder resin.

The coloring agent for use in the present invention can be used in the form of a master batch which is a composite of the coloring agent and a resin. As a binder resin for the production of the master batch or as a binder resin to be kneaded with the master batch, there can be employed polystyrene, and polymers of styrene and substituted styrenes such as p-chlorostyrene and polyvinyl toluene, in addition to the above-mentioned polyester resin; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-isoprene copolymer, styrene-acrylonitrile-indene copolymer, styrene-maleic acid copolymer, and styrene-maleic acid ester copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified resin, terpene resin, aliphatic or alicyclic hydrocarbon resin, aromatic petroleum resin, chlorinated paraffin, and paraffin wax. These can be used alone or in combination.

The master batch can be obtained by mixing the resin for the master batch and the coloring agent with the application of high shear force and kneading the mixture. At this moment, an organic solvent can be used in order to enhance the interaction between the coloring agent and the resin.

In addition, a so-called flashing method can be preferably employed, in which an aqueous paste of the coloring agent and water is kneaded together with the resin and an organic solvent, whereby the coloring agent is transferred to the side of the resin, and the water and the organic solvent are removed therefrom to form a wet cake of the coloring agent. In this method, the wet cake of the coloring agent can be used as it is, so that it is unnecessary to dry the mixture. For performing the mixing and the kneadling, a dispersing apparatus with high shear force, such as a three-roll mill, can be preferably employed.

As the charge controlling agent, which is used in the toner of the present invention when necessary, conventional charge controlling agents can be used alone or in combination. Specifically, there can be given metal chelate compounds, metal salts of organic acids, metal-containing dyes, Nigrosine dyes, amide-group-containing compound, phenol compound and naphthol compound and metal salts thereof, urethane-bond-containing compounds, and acidic or electron-attractive organic materials. When the adaptability to color toner is taken into account (that is, the charge controlling agent itself being colorless or pale and having no color hindrance to toner), for negative charging, preferable are metal salts and metal complexes of salicylic acid or alkyl salicylic acid with chromium, zinc, and aluminum, metal salts and metal complexes of benzilic acid, amide compound, phenol compound, naphthol compound, phenol amide compound, and hydroxynaphthalene compound such as 4,4'-methylenebis-[2-[N-(4-chlorophenyl)amide]-3-hydroxynaphthalene. The amount thereof for use may be determined in accordance with the desired charge quantity, but normally 0.01 to 10 parts by weight, preferably 0.1 to 10 parts of the charge controlling agent are used per 100 parts by weight of a binder agent.

As the wax for use in the present invention, there can be employed conventional waxes, for example, polyolefin waxes such as polyethylene wax, and polypropylene wax; long-chain hydrocarbons such as paraffin wax and polypropyle wax; and carbonyl-group-containing wax. Of these waxes, carbonyl-group-containing wax is preferable for use. Specific examples of the carbonyl-group-containing wax are polyalkanic acid ester such as carnauba wax, montan wax, trimethylolpropane tribehenate, pentaerythritol tetrabehenate, pentaerythritol diacetate dibehenate, glycerin tribehenate, and 1,18-octadecanediol-bisstearate; polyalkanol ester such as tristearly trimellitate and distearyl maleate; polyalkanamide such as ethylene diamine dibehenylamide; polyalkyl amide such as trimellitic acid tristearyl amide; and dialkyl ketone such as distearly ketone. Of these carbonyl-group-containing waxes, polyalkanic acid ester is preferable. The content of the wax in the toner is usually in the range of from 0 to 40 wt. %, preferably in the range of from 2 to 30 wt. %, more preferably in the range of from 3 to 30 wt. %.

The method of producing the toner of the present invention can be carried out by dispersing in an aqueous solvent a toner composition which comprises (1) a composition thermally soluble in an organic solvent and (2) a coloring agent, thereby forming toner particles. The following are preferable examples thereof, but the present invention is not limited thereto:

A dispersion comprising (a) a polyester resin dissolved in an organic solvent, (b) a coloring agent, and (c) a metal alcolate and/or a metal chelate compound is dispersed in an aqueous solvent, whereby a toner particle matrix is formed. From this mixture the organic solvent is removed, whereby the desired toner particles are obtained.

As a method of forming the toner particle matrix in a stable manner in the aqueous solvent, there can be given, for example, a method of adding the above-mentioned dispersion to the aqueous solvent, and dispersing the dispersion with the application of shear force thereto.

In the present invention, it is not always necessary that other raw materials for the toner, such as the coloring agent, a releasing agent, and a charge controlling agent be mixed before the particles are formed in the aqueous solvent, but such raw materials may be added after the particles have been formed. For example, particles free of a coloring agent are formed and then the coloring agent can be added thereto by a conventional dyeing method.

There is no particular limitation to the dispersion method. There can be employed conventionally known apparatus such as a low-speed shearing type dispersion apparatus, a high-speed shearing type dispersion apparatus, a friction type dispersion apparatus, a high-pressure jet type dispersion apparatus, and an ultrasonic type dispersion apparatus. In order to obtain a dispersion including particles with a particle diameter of from 2 to 20 μm, the high-speed shearing type dispersion apparatus is preferable for use.

When the high-speed shearing type dispersion apparatus is used, there is no particular limitation to the number of revolutions, but the number of revolutions is usually in the range of from 1000 to 30000 rpm, preferably in the range of from 5000 to 20000 rpm.

There is no particular limitation to the dispersion time, but in the case of a batch system, the dispersion time is usually in the range of from 0.1 to 5 minutes. The temperature during the dispersion is usually in the range of from 1 to 150° C. (under the application of pressure), preferably in the range of from 10 to 98° C.

The amount of the aqueous solvent per 100 parts by weight of the dispersion is usually in the range of from 50 to 2000 parts by weight, preferably in the range of from 100 to 1000 parts by weight. When the amount of the aqueous solvent is less than 50 parts by weight per 100 parts by weight of the dispersion, the dispersion state of the dispersion is not so good that toner particles with the desired toner particle diameter cannot be obtained. However, the use of the aqueous dispersion in an amount that exceeds 2000 parts by weight is not economical.

When necessary, a dispersant can be employed. It is preferable to use a dispersant to make a particle distribution sharper, and to stabilize the dispersing. As such a dispersant, there can be employed water-soluble polymers such as polyvinyl alcohol, hydroxyethyl cellulose, carboxylmethyl cellulose, and polyvinyl pyrrolidone, inorganic powders such as calcium carbonate powder, calcium phosphate powder, hydroxy apatite powder, and silica fine powder, and surfactants such as a nonionic surfactant, and an anionic surfactant, which are conventional ones.

Specific examples of the anionic surfactant are fatty acid soaps such as sodium stearate, sodium dodecanate, dodecyl sodium sulfate, dodecylbenzene sodium sulfonate, and lauryl sodium sulfate.

Specific examples of the nonionic surfactant are polyoxyethylene dodecyl ether, polyoxyethylene hexadecyl ether, polyoxyethylene nonylphenyl ether, polyoxyethylene lauryl ether, polyoxyethylene sorbitan monooleate ether, and monodecanoyl sucrose. Furthermore, emulsion-polymerized emulsions, for instance, emulsions with a copolymerized (meth)acrylic acid, can be effectively used for stabilizing the dispersion.

As the organic solvent for use in the present invention, conventional organic solvents can be employed as long as the polyester resin can be dissolved therein. Volatile organic solvents with a boiling point of less than 100° C. are preferable since they can be removed easily. Examples of such an organic solvent are ethyl acetate, acetone, methyl ethyl ketone, and THF.

The amount of such an organic solvent to be used per 100 parts by weight is usually in the range of from 10 to 500 parts by weight, preferably in the range of from 20 to 400 parts by weight, more preferably in the range of from 50 to 300 parts by weight. In order to eliminate the organic solvent from the toner matrix particles dispersed in the aqueous solvent, there can employed a conventionally known method is employed in which the organic solvent is eliminated with the application of heat thereto under a normal or reduced pressure. At this moment, the polyester resin with an acid value and the metal alcolate and/or the methal chelate compound react to cause a cross-linking reaction which terminates quickly unlike the reaction, for instance, with isocyanate.

The toner particle matrix liquid is then subjected to solid-liquid separation by use of a centrifuge, a sparkler filter, and a filter press to obtain a powder. The thus obtained powder is then dried, whereby a toner of the present invention can be obtained.

The thus obtained toner is then dried by use of a conventional apparatus such as a pneumatic conveying dryer, a vibrating fluidization dryer, a fluidized bed type dryer, a reduced-pressure dryer, and an air-circulation dryer alone or in combination. Furthermore, when necessary, the toner can be classified to obtain a toner with a predetermined particle size distribution by use of, for in example, a pneumatic classifier.

When necessary, the toner of the present invention can be used with the addition thereto of an additive such as a fluidizing agent. Specific examples of the fluidizing agent are fine powders of hydrophobic silica, titanium oxide, and aluminum oxide. The amount of such a fluidizing agent to be added per 100 parts by weight of a binder agent is usually in the range of from 0.01 to 8 parts by weight, preferably in the range of from 0.1 to 5 parts by weight.

In the toner of the present invention, there can be used, as an agent to be added externally or internally, an electric resistance adjusting agent or a lubricant such as inorganic fine powders of magnetite, ferrite, cerium oxide, strontium titanate, and electroconductive titania, styrene resin, and acrylic resin. The amount of these additives to be added is appropriately selected in accordance with the desired performance, and is usually in an amount of about 0.05 to 10 parts by weight per 100 parts by weight of the binder agent.

The toner for image formation of the present invention may be used either in the form of a two-component type developer or in the form of a non-magnetic mono-component type developer.

When the toner of the present invention is used in the form of the two-component type developer, there can be used as a carrier therefor conventionally known magnetic materials such as iron powder, magnetite powder, and ferrite powder, and resin-coated iron powder, magnetite powder, and ferrite powder at the surface thereof, and a magnetic carrier. As the resin for the resin coating of the resin-coated carrier, there can be employed, for example, styrene resin, acrylic resin, styrene-acrylic copolymer resin, silicone resin, modified silicone resin, fluoroplastics, and mixtures of these resins.

In order to perform image formation with high resolution, the volume mean diameter of the toner is preferably in the range of from 3 to 8 μm, more preferably in the range of from 4 to 7 μm. Furthermore, it is preferable that the particle size distribution be such that the ratio of the volume mean diameter/the particle number mean diameter is in the range of from 1 to 2.5.

For producing such a toner easily, the method of producing the toner of the present invention is suitable.

Either when the toner of the present invention is used in the form of a mono-component type developer or when the toner of the present invention is used in the form of a two-component type developer, the toner of the present invention is placed in a toner container. The toner container filled with the toner is generally placed on the market, apart from the image forming apparatus, so that the customers usually attach the toner container to the image forming apparatus by themselves.

There is no particular limitation to the toner container. It may be, for example, in the form of a bottle or in the form of a cartridge, as is used conventionally. The cartridge includes not only a conventional cartridge including a conventional toner container, but also a process cartridge in general use.

Furthermore, there is no particular limitation to the image forming apparatus as long as it is an apparatus for forming images electrophotographically, so that the image forming apparatus includes a cartridge-mounted image forming apparatus such as a copying machine and a printer.

The method and the apparatus for determining the physical values of the materials used in the present invention will now be explained.

(1) The glass transition temperature (Tg) of resin

The Tg is determined by the steps of subjecting the resin to DSC measurement under the conditions of raising the temperature at a rate of 10° C./min by use of a commercially available apparatus (Rigaku THERMOFLEX TG8110, made by Rigaku Denki Co., Ltd.) and subjecting the result of the DSC measurement at a second time to a tangent method.

(2) The acid value and the hydroxyl value of resin

The measurement of each of these values is conducted in accordance with the Japanese Industrial Standards (JIS K0070), provided that a solvent such as dioxane, THF, o-dichlorobenzene is used for an insoluble sample.

(3) The molecular weight distribution of resin

The molecular weight distribution is measured by GPC (gel permeation chromatography).

The measurement is conducted as follows:

The column is stabilized at 145° C. in a heat chamber.

As an eluate, o-dichlorobenzene containing 0.3% BHT is caused to flow through the column at this temperature at a flow rate of 1 ml/min. 50 to 200 μl of o-dichlorobenzene solution of a sample resin with a concentration of 0.3 wt. % at 140° C. is injected to measure the molecular weight distribution of the resin.

As the apparatus for the measurement, 150 CV type, made by Waters, can be used, and as the column, Shodex AT-G+AT-806MS (2 colums) can be used.

In the measurement of the molecular weight of a sample, the molecular weight distribution of the sample is calculated from the relationship between the logarithmic value of a calibration curve prepared by use of several kinds of monodisperse polystyrene standard samples and a count number. A slice width is 0.05 seconds. As the standard polystyrene samples for preparation of the calibration curve were used samples made by Pressure Chemical Co., or Toyo Soda Kogyo Co., Ltd., with the following molecular weights: $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. Of these, at least about 10 standard polystyrene samples are used. As an analyzer, an RI (refractive index) analyzer is used.

(4) The glass transition temperature (Tg) of releasing agent

The Tg thereof is measured in the same manner as in the above-mentioned resin.

(5) The mean particle diameter and the particle size distribution of the toner

The mean particle diameter and the particle size distribution of the toner are measured by Coulter counter method. As the apparatus for measuring the particle size distribution of toner particles, there are Coulter counter TA-II and Coulter multi-analyzer II (both of them are made by Coulter Electronics, Inc.).

In the present invention, the mean particle diameter and the particle size distribution of the toner are measured by use of Coulter counter TA-II, with an interface (made by Nikkaki Bois Co., Ltd.) which outputs number distribution and volume distribution being connected to a personal computer (PC9801 made by NEC Corp.).

Method of Measuring the Number Distribution and the Volume Distribution of Toner Particles For conducting this measurement, 0.1 to 5 ml of a surfactant (preferably an alkylbenzene-sulfonate) is added as a dispersant to 100 to 150 ml of an electrolytic aqueous solution. The electrolytic aqueous solution means here an about 1% NaCl aqueous solution which is prepared by use of a first grade sodium chloride. As such an electrolytic aqueous solution, for example, ISTON-11 (Coulter Scientific Japan Co.) can be used.

2 to 20 mg of a sample to be measured is added to the above electrolytic solution and dispersed in an ultrasonic dispersing apparatus for about 1 to 3 minutes. By use of the above-mentioned measurement apparatus, provided with a 100 μm aperture, the volume and the number of particles of the toner particles are measured, and then the volume distribution and the number distribution of the toner particles are calculated therefrom.

The particles with a particle size in the range of from 2.00 μm to 40.30 μm are subjected to this measurement, using the following 13 channels:

2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm.

The weight mean particle diameter (Dv) with a volume basis of the toner, determined from the volume distribution thereof, and the number mean particle diameter (Dn) are obtained, from which the ratio of Dv/Dn is obtained.

The present invention will now be explained in detail with reference to the following examples. However, the present invention is not limited to the following examples.

Other features of this invention will become apparent in the course of the following description of exemplary embodiments which are given for illustration of the invention and are not intended to be limiting thereof.

EXAMPLES OF PREPARATION OF POLYESTER RESINS

The raw materials, with each of the formulations, shown in Table 1, were placed in a reaction chamber equipped with a reflux condenser, a stirrer, and a nitrogen-gas introduction tube, with the addition thereof of 1 part by weight of dibutyl tin oxide and 0.05 parts by weight of hydroquinone, and were allowed to react at 180° C. at atmospheric pressure for 8 hours. The temperature of the reaction mixture was then raised to 200° C. and was reacted under reduce pressure of 10 to 15 mmHg until a polyester resin with the desired softening point $F_{1/2}$ was obtained.

Table 1 shows the formulation and the physical properties of each of the polyester resins A1 to A7 thus obtained.

Example 1

In a container equipped with a stirrer and a thermometer, the following components were placed with the following formulation:

| | Parts by Weight |
|---|---|
| polyester resin A1 | 382 |
| polyester resin A2 | 68 |
| carnauba wax | 28 |
| carbon black (REGAL 400R, made by Cabot Corp.) | 36 |
| CCA (E-84, Salicylic acid metal complex, made by Orient Chemical Industries, Inc.) | 5 |
| aluminum trisacetylacetonate | 4.2 |
| ethyl acetate | 510 |

The above reaction mixture was heated to 80° C. with stirring, and was maintained at the same temperature with stirring for 5 hours, and then cooled to 30° C., taking the time of one hour.

The reaction mixture was then dispersed so as to disperse the carbon black and the wax sufficiently by use of a bead mill (ULTRA VISCO MILL, made by IMEX Co., Ltd.) under the conditions that the liquid feeding rate was 1 kg/hr, the disc peripheral speed was 6 m/sec, and the filling ratio of 0.5 mm zirconia beads was 80 volume %, using 3 paths, whereby a colored organic solvent dispersion was obtained.

In another container, the following components were placed and mixed with stirring, whereby an aqueous solution was obtained:

| | Parts by Weight |
|---|---|
| deionized water | 1050 |
| sodium dodecylbenzenesulfonate | 7.6 |
| sodium dodecyldiphenyl ether disulfonate | 2.6 |
| carboxymethyl cellulose (CELLOGEN BSH, made by DAI-ICHI KOGYO SEIYAKU Co., Ltd.) | 2.5 |

To the thus obtained aqueous solution was added the above-mentioned colored organic solvent dispersion. The mixture was then mixed in TK homomixer (made by TOKUSHUKIKA KOGYO Co., Ltd.) at 13,000 rpm for 30 minutes, whereby a toner matrix particle dispersion was obtained.

The toner matrix particle dispersion was placed in a container equipped with a stirrer and a thermometer and was subjected to solvent-elimination processing at 30° C. for 8 hours and was then subjected to aging at 45° C. for 4 hours, whereby a toner slurry was obtained.

A liquid was removed from this toner slurry by filtration to obtain a wet toner. The wet toner was then dried, whereby a toner was obtained. The volume mean particle diameter of the thus obtained toner was measured by Multisizer. The volume mean particle diameter of the toner was 4.65 μm.

To 100 parts of this toner were added 1.5 parts of hydrophobic silica (R-972, made by Aerosil Japan Co., Ltd.), and the mixture was mixed in a Henschel mixer, whereby a toner sample No. 1 for evaluation was prepared.

Examples 2 to 6

Toner samples Nos. 2 to 6 were prepared in the same manner as in Example 1 except that the formulation of the toner in Example 1 was changed as shown in Table 2, with respect to the polyester resin other than the polyester resin A1 and the wax.

Comparative Example 1

Comparative toner sample No. 1 was prepared in the same manner as in Example 1 except that aluminum trisacetylacetate employed in Example 1 was not added.

Comparative Example 2

In a container equipped with a reflux condenser, a stirrer and a nitrogen-gas introduction tube, the following components were placed with the following formulation:

| | Parts by Weight |
|---|---|
| polyester resin A1 | 100 |
| tolylenediisocyanate (TDI) | 20 |
| dibutyl tin oxide | 0.5 |
| ethyl acetate | 80 |

The above reaction mixture was allowed to react with the ethyl acetate being refluxed at atmospheric pressure for 3 hours, and was then cooled.

The ethyl acetate was then removed under reduced pressure, whereby a polyester resin B1 with isocyanate at the terminal thereof.

A comparative toner sample No. 2 was obtained in the same manner as in Example 1 except that the polyester resin A2 used in Example 1 was replaced by the above obtained polyester B1.

Evaluation

Each of the above obtained toner samples was evaluated with respect to (1) image fixing performance, (2) chargeability, and (3) preservation stability.

(1) Evaluation of image fixing performance

A commercially available copying machine (MF2200, made by Ricoh Company, Ltd.) with a modified image fixing unit was used for the evaluation of each of the toner samples with respect to the image fixing performance thereof. As a copying paper, a commercially available copying paper (Type 6200, made by Ricoh Company, Ltd.) was used.

Each of the toner samples was set in the above copying machine, and a copying test was conducted, using the above copying paper. In the copying test, (a) a cold offset temperature which is a lower limit temperature at which image fixing can be carried out, and (b) a hot offset temperature which is an upper limit temperature above which image fixing cannot be carried out due to the occurrence of hot offset were determined by changing the image fixing temperature.

The evaluation of the cold offset temperature was carried out under the following conditions:

| | |
|---|---|
| copying paper feeding speed: | 120 to 150 mm/sec |
| pressure applied by an image fixing roller: | 1.2 Kgf/cm$^2$ |
| nip width of the image fixing area: | 3 mm |

The evaluation of the hot offset temperature was carried out under the following conditions:

| | |
|---|---|
| copying paper feeding speed: | 50 mm/sec |
| pressure applied by an image fixing roller: | 2.0 Kgf/cm$^2$ |
| nip width of the image fixing area: | 4.5 mm |

The results are shown in Table 3. The cold offset temperature of a conventional toner is in the range of from 140° C. to 150° C.

In Table 3, FIGS. 5, 4, 3, 2, and 1 in the row of the lowest image fixing temperature denote as follows:

5: less than 120° C.;

4: 120° C. to 130° C.;

3: 130° C. to 140° C.;

2: 140° C. to 150° C.;

1: more than 150° C.

Further, in Table 3, FIGS. 5, 4, 3, 2, and 1 in the row of the hot offset temperature denote as follows:

5: more than 201° C.;

4: 200° C. to 191° C.;

3: 190° C. to 181° C.;

2: 180° C. to 171° C.;

1: 170° C. or less.

(2) The evaluation of chargeability

Each of the above toner samples was mixed with a carrier (FL-100, made by POWDER-TEC. Co., Ltd.) to prepare a developer with a toner concentration of 5%. The developer was stirred in a ball mill for 1 hour, and then 6 g of the developer was placed in a metal cylinder that can be sealed tightly and subjected to blowing, whereby the charge quantity (μC/g) of each toner sample was measured. The results are shown in Table 3.

(3) The evaluation of preservation stability

Each of the toner samples was placed in a glass container and was then allowed to stand in a constant temperature bath at 50° C. for 24 hours. The toner sample was then cooled to 24° C., and was subjected to penetration measurement in accordance with the Japanese Industrial Standards (JIS K2235-1991). The larger the value of the penetration, the better the thermal preservation stability. A toner with a penetration value of 5 mm or less has a problem when used in practice. The results of the measurement and the evaluation thereof are shown in Table 3.

In Table 3, FIGS. 5, 4, 3, 2, and 1 in the row of the preservation stability denote the degree of the penetration as follows:

5: pass through

4: 25 mm or more

3: 20 to 25 mm

2: 15to 20 mm

1: less than 15 mm

TABLE 1

| | | Polyester Resins | | | | | | |
|---|---|---|---|---|---|---|---|---|
| Alcohol Components | Unit | A1 | A2 | A3 | A4 | A5 | A6 | A7 |
| BPA-PO* | parts by weight | 1150 | 1610 | 1150 | 805 | 1035 | 1725 | 1150 |
| BPA-EO** | parts by weight | 1010 | 525 | 1050 | 707 | 1010 | 505 | 1131 |
| 1,4-butanediol | parts by weight | 0 | 0 | 0 | 113 | 0 | 23 | 0 |
| 1,6-hexanediol | parts by weight | 0 | 0 | 0 | 0 | 35 | 30 | 0 |
| ethylene glycol | parts by weight | 0 | 12 | 0 | 0 | 0 | 0 | 0 |
| Acid Components | | | | | | | | |
| terephthalic acid | parts by weight | 822 | 913 | 598 | 664 | 664 | 747 | 598 |
| Fumaric acid | parts by weight | 0 | 0 | 0 | 0 | 29 | 46 | 0 |
| succinic acid | parts by weight | 0 | 65 | 165 | 153 | 118 | 59 | 177 |
| trimellitic anhydride | parts by weight | 0 | 19 | 77 | 0 | 38 | 96 | 67 |
| Physical Properties | | | | | | | | |
| Glass transition temp. | ° C. | 58 | 67 | 45 | 53 | 51 | 66 | 53 |
| Softening Point ($F_{1/2}$) | ° C. | 110 | 98 | 107 | 111 | 105 | 114 | 100 |
| Molecular Weight | | 5920 | 5580 | 6380 | 5530 | 8100 | 7310 | 4550 |
| Acid Value | mgKOH/g | 1.2 | 30.5 | 8.6 | 28 | 20.3 | 14.5 | 6.6 |

BPA-PO*: Bisphenol A-propylene oxide

BPA-EO*: Bisphenol A-ethylene oxide

TABLE 2

| | Example 1 | Example 2 | Example 3 | Example 4 | Example 5 | Example 6 |
|---|---|---|---|---|---|---|
| Polyester resin A1 (parts by weight) | 383 | 360 | 405 | 383 | 383 | 360 |
| Another polyester resin | A2 | A3 | A4 | A5 | A6 | A7 |
| (parts by weight) | 68 | 90 | 45 | 68 | 68 | 90 |
| Kind of wax | carnauba | carnauba | carnauba | B-wax* | B-wax* | B-wax* |
| (parts by weight) | 23 | 27 | 19 | 36 | 29 | 23 |
| Aluminum trisacetylacetonate (parts by weight) | 4.2 | 1.5 | 2.6 | 2.8 | 2.0 | 1.5 |

B-wax*: pentatristoretetrabehenate

TABLE 3

| | Ex. 1 | Ex. 2 | Ex. 3 | Ex. 4 | Ex. 5 | Ex. 6 | Com. Ex. 1 | Com. Ex. 2 |
|---|---|---|---|---|---|---|---|---|
| Lowest image fixing temp. | 5 | 5 | 4 | 5 | 4 | 4 | 4 | 1 |
| Hot offset temperature | 5 | 4 | 5 | 5 | 5 | 5 | 1 | 4 |
| Charge quantity (μC/g) | −14.6 | −20.1 | −8.8 | −15.5 | −22.8 | −11 | −10.2 | +15.8 |
| Preservation stability | 5 | 5 | 5 | 5 | 4 | 4 | 1 | 5 |

According to the present invention, there can be provided a toner which is capable of satisfying the requirements for the required low-temperature image fixing as well as the required image fixing temperature range, and a method of producing the toner.

Furthermore, the present invention provides toner containers such as a toner cartridge and a process cartridge which are loaded with the toner. Such toner containers can be detachably mounted on an image forming apparatus.

All references, patents, applications, etc. mentioned above are incorporated herein by reference, as are Japanese priority documents 2003-75497 and 2003-128384.

What is claimed is:

1. A toner for image formation, which is produced by dispersing in an aqueous solvent a toner composition comprising (1) a composition that is thermally soluble in an organic solvent and (2) a coloring agent, thereby forming toner particles, wherein said thermally soluble composition comprises a polyester with an acid value and at least one of a metal alcolate and a metal chelate compound, the metal alcolate and the metal chelate compound having a reactivity with the polyester with an acid value.

2. The toner as claimed in claim 1, wherein said acid value of said polyester is in the range of from 3 KOH/g to 4 mg KOH/g.

3. The toner as claimed in claim 1, wherein said metal alcolate and/or metal chelate compound comprises at least one metal ion selected from the group consisting of aluminum ion, titanium ion, and zirconium ion.

4. A container comprising a toner according to claim 1.

5. In a toner cartridge comprising a toner, the improvement comprising using as the toner a toner according to claim 1.

6. In a process cartridge comprising a toner, the improvement comprising using as the toner a toner according to claim 1.

7. In an image forming apparatus, to which a toner container comprising a toner is detachably attached, the improvement comprising using as the toner a toner according to claim 1.

8. The image forming apparatus as claimed in claim 7, wherein said toner container is a toner cartridge.

9. The image forming apparatus as claimed in claim 7, wherein said toner container is a process cartridge.

10. The toner as claimed in claim 1, wherein toner particle formation does not involve a nitrogen-containing compound.

11. A toner for image formation, which is produced by dispersing in an aqueous solvent a toner composition comprising (1) a composition thermally soluble in an organic solvent and (2) a coloring agent, thereby forming toner particles, wherein when said solvent is eliminated from said toner composition, said thermally soluble composition comprises a gel structure comprising a polyester with an acid value and at least one of a metal alcolate and a metal chelate compound, the metal alcolate and the metal chelate compound having a reactivity with the polyester with an acid value.

12. The toner as claimed in claim 11, wherein said acid value of said polyester is in the range of from 3 mg KOH/g to 4 mg KOH/g.

13. The toner as claimed in claim 11, wherein said metal alcolate and/or metal chelate compound comprises at least one metal ion selected from the group consisting of aluminum ion, titanium ion, and zirconium ion.

14. A container comprising a toner according to claim 11.

15. In a toner cartridge comprising a toner, the improvement comprising using as the toner a toner according to claim 11.

16. In a process cartridge comprising a toner, the improvement comprising using as the toner a toner according to claim 11.

17. In an image forming apparatus, to which a toner container comprising a toner is detachably attached, the improvement comprising using as the toner a toner according to claim 11.

18. The image forming apparatus as claimed in claim 17, wherein said toner container is a toner cartridge.

19. The image forming apparatus as claimed in claim 17, wherein said toner container is a process cartridge.

20. A method of producing a toner for image formation, comprising dispersing in an aqueous solvent a toner composition comprising (1) a composition that is thermally soluble in an organic solvent and (2) a coloring agent, thereby forming toner particles, wherein said thermally soluble composition comprises a polyester with an acid value and at least one of a metal alcolate and a metal chelate compound, the metal alcolate and the metal chelate compound having a reactivity with the polyester with an acid value.

* * * * *